US010321746B2

(12) United States Patent
Kaplan

(10) Patent No.: US 10,321,746 B2
(45) Date of Patent: Jun. 18, 2019

(54) LIP BALM AND CONTAINER THEROF

(71) Applicant: K7 Design Group Corporation, Brooklyn, NY (US)

(72) Inventor: Michael Kaplan, Brooklyn, NY (US)

(73) Assignee: K7 Design Group Corporation, Brooklyn, NY (US)

( * ) Notice: Subject to any disclaimer, the term of this patent is extended or adjusted under 35 U.S.C. 154(b) by 0 days.

(21) Appl. No.: 15/982,563

(22) Filed: May 17, 2018

(65) Prior Publication Data

US 2018/0332948 A1 Nov. 22, 2018

Related U.S. Application Data

(60) Provisional application No. 62/507,276, filed on May 17, 2017.

(51) Int. Cl.
*A45D 40/00* (2006.01)
*A45D 40/22* (2006.01)

(52) U.S. Cl.
CPC ..... *A45D 40/221* (2013.01); *A45D 40/00* (2013.01); *A45D 40/222* (2013.01); *A45D 2040/0025* (2013.01); *A45D 2040/228* (2013.01); *A45D 2200/05* (2013.01)

(58) Field of Classification Search
CPC ..... A45D 40/222; A45D 2040/0025; A45D 2040/228; A45D 2200/05; A45D 40/00
USPC ..... 206/385; 401/88
See application file for complete search history.

(56) References Cited

U.S. PATENT DOCUMENTS

| | | | | |
|---|---|---|---|---|
| 829,327 | A | 8/1906 | Crisp | |
| 1,852,455 | A * | 4/1932 | Friedman | A45D 33/00 132/293 |
| D95,769 | S | 5/1935 | Meilner | |
| 2,276,047 | A * | 3/1942 | Kurth | A45D 40/00 401/19 |
| 2,625,292 | A | 1/1953 | Spender | |
| D189,076 | S | 10/1960 | Altman | |
| 4,459,058 | A | 7/1984 | Bennett | |
| D280,667 | S | 9/1985 | Bennett | |

(Continued)

OTHER PUBLICATIONS

Wax packaging for cheese, Babybel, posted at cheese.com, posted by Matthew Bellemare et. al., various images from Jan. 17, 2014 and Jan. 16, 2015 © 2018 © World news, Inc. , online, site visited Aug. 18, 2018. Available from Internet, U RL: https:// www.cheese.com/babybel/# (Year: 2015).

*Primary Examiner* — King M Chu
(74) *Attorney, Agent, or Firm* — Lerner, David, Littenberg, Krumholz & Mentlik, LLP

(57) ABSTRACT

A lip balm container includes a first container element that defines a first compartment configured to house a first portion of lip balm such that a second portion of the lip balm extends from the compartment, and a second container element connected to the first container element and moveable relative thereto between a closed and an open position. When in the closed position, the second container element covers the second portion of the mass of lip balm extending from the first compartment of the first container element, and in the open position, the second portion of the lip balm is exposed for use. The second container element remains connected to the first container element as the second container element is moved between the open and closed positions.

14 Claims, 5 Drawing Sheets

(56) References Cited

U.S. PATENT DOCUMENTS

| | | | | |
|---|---|---|---|---|
| D285,052 | S | 8/1986 | Bianchi et al. | |
| D309,433 | S | 7/1990 | Minuti | |
| D360,788 | S | 8/1995 | Cousins | |
| D426,852 | S | 6/2000 | Gstalder | |
| D469,125 | S | 1/2003 | Jacquet | |
| D479,689 | S | 9/2003 | Altonen et al. | |
| 6,616,274 | B1 * | 9/2003 | Sabia | A45C 11/04 24/3.8 |
| D505,865 | S | 6/2005 | Seizer et al. | |
| D534,794 | S | 1/2007 | Åkeson | |
| D561,022 | S | 2/2008 | Terrasi | |
| D568,692 | S | 5/2008 | Lam | |
| D590,444 | S | 4/2009 | Farnworth et al. | |
| D624,829 | S | 10/2010 | Ramsey et al. | |
| 7,886,395 | B2 | 2/2011 | Farnworth et al. | |
| 8,100,260 | B1 * | 1/2012 | Weckerle | A45D 40/065 206/385 |
| 8,528,789 | B2 | 9/2013 | Ramsey et al. | |
| D733,287 | S | 6/2015 | Bilgic | |
| D767,114 | S | 9/2016 | White et al. | |
| D769,439 | S | 10/2016 | White et al. | |
| D780,850 | S | 3/2017 | Racamier et al. | |
| 10,039,366 | B1 | 8/2018 | Facer et al. | |
| 2011/0135377 | A1 * | 6/2011 | Teller | A45D 40/00 401/88 |
| 2015/0037082 | A1 * | 2/2015 | Pires | A45D 40/00 401/88 |

* cited by examiner

LIP BALM AND CONTAINER THEROF

CROSS-REFERENCE TO RELATED APPLICATIONS

This application claims the benefit of the filing date of U.S. Provisional Patent Application No. 62/507,276, filed May 17, 2017, the disclosure of which is hereby incorporated herein by reference.

BACKGROUND OF THE INVENTION

Skin care products, such as lip balm, and other consumable products are typically provided in a container with a removable lid so that the consumer can transport the product and access it as needed. Such removable lids can accumulate residual product on their exterior during handling. Such residual product can easily accumulate dirt or hair if the lid is accidentally dropped. Moreover, many current containers can be inadvertently opened, particularly when in a purse, makeup bag, luggage or the like, such that the lip balm or other consumable product creates a mess. Thus, despite the many variations and improvements over the years in consumer product containers, further improvements are desirable.

BRIEF SUMMARY OF THE INVENTION

Described in the present disclosure is a container assembly for a consumable product, such as a mass of skin protectant material. Such skin protectant material may include lip balm, sunscreen and the like. In this regard, the skin protectant is housed within a first container element. A second container element or lid is connected to the first container element and is moveable between an open position in which the skin protectant is exposed for use and a closed position in which the skin protectant is encapsulated by the container elements. The second container element is biased toward the closed position to help prevent inadvertent opening of the container assembly. In this regard, the container is self-closing. However, the container assembly includes a locking feature that allows the second container element to remain in the open position while the consumer uses the product contained therein. Additionally, the bias of the second container element makes it so that, when the lock produced by the locking feature is overcome, the product is automatically covered without excessive manipulation of the container. Moreover, the container assembly may be provided in a convenient shape for transport.

BRIEF DESCRIPTION OF THE DRAWINGS

The features, aspects, and advantages of the present invention will become better understood with regard to the following description, appended claims, and accompanying drawings in which:

DETAILED DESCRIPTION

As used herein, the terms "about," "generally," and "substantially" are intended to mean that deviations from absolute are included within the scope of the term so modified.

Figure 1:
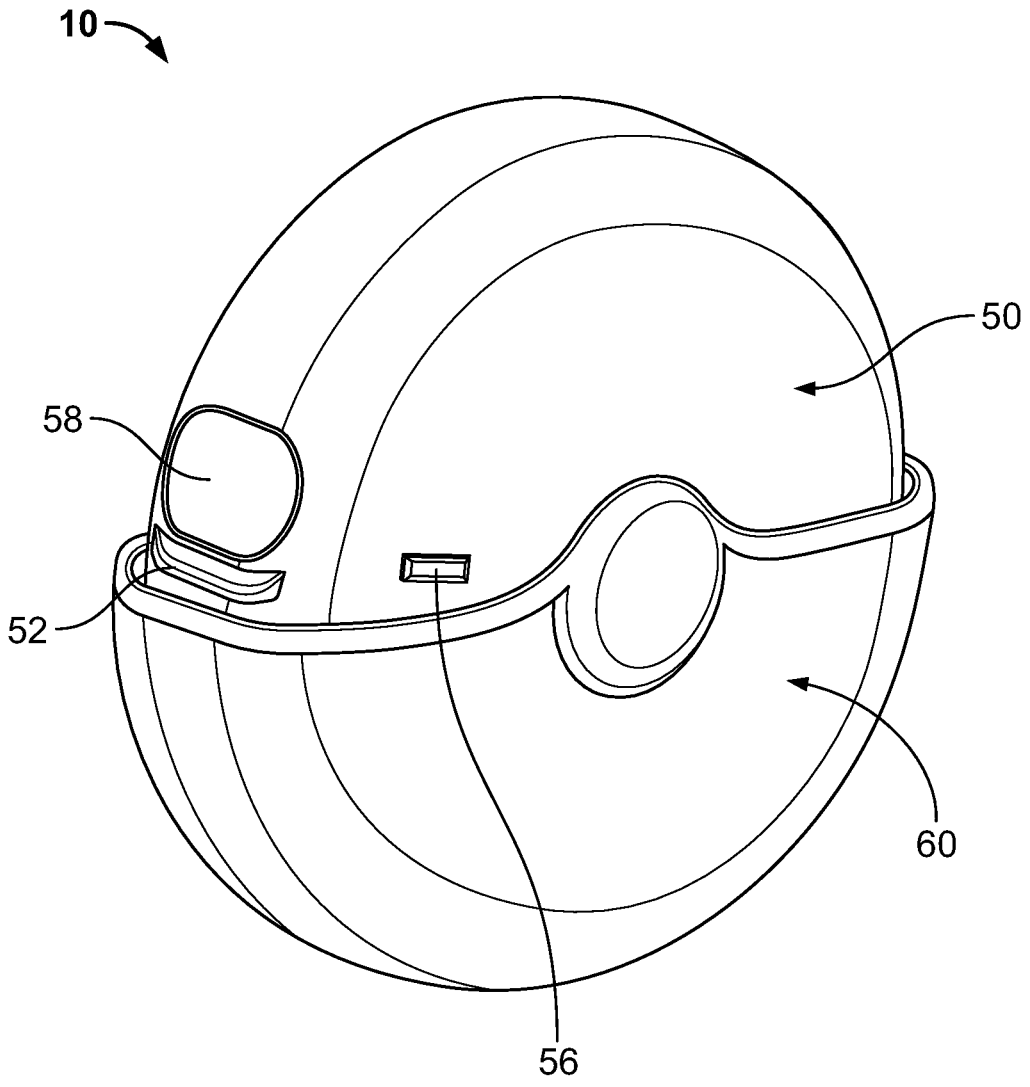
FIG. 1 is a perspective view of a container assembly according to an embodiment of the disclosure.
Figure 2:
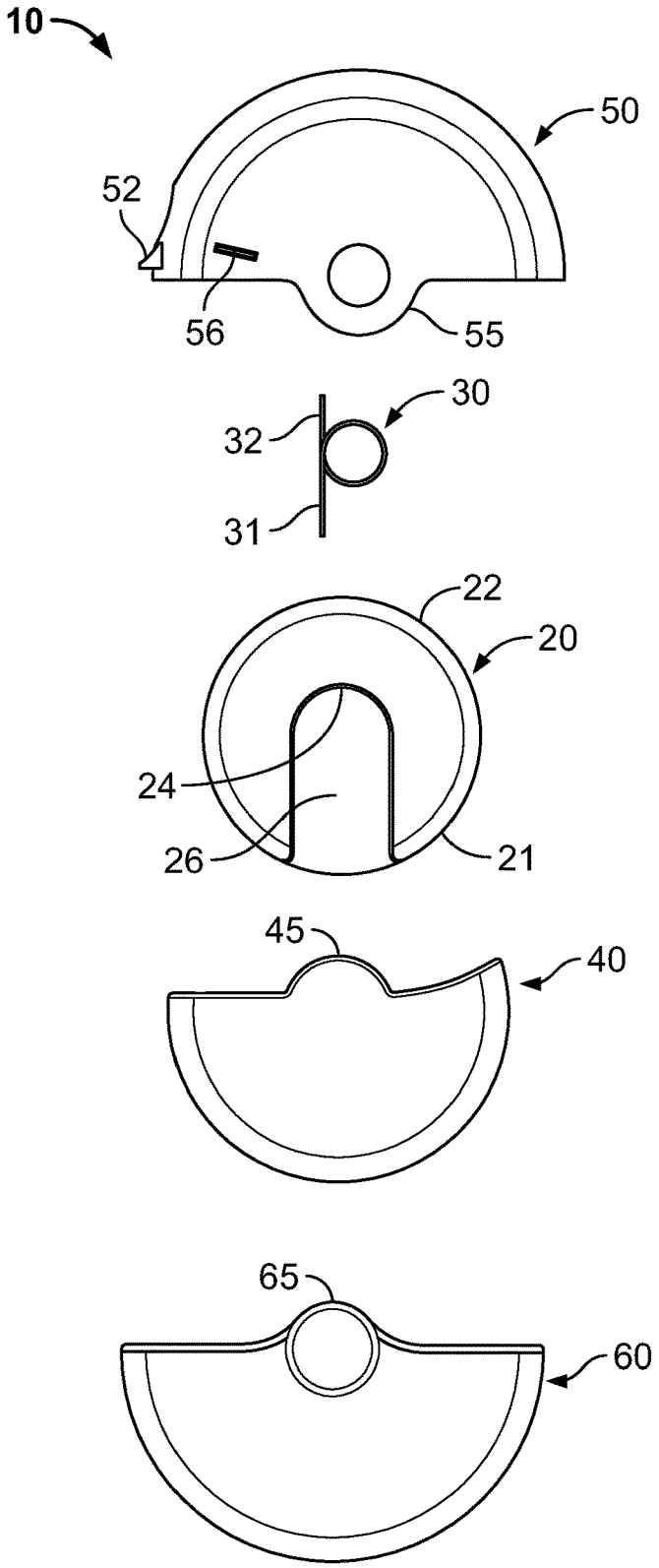
FIG. 2 is an exploded view of the container assembly of FIG. 1.

FIGS. 1-9 depict a container assembly 10 according to an embodiment of the present disclosure. As best shown in FIG. 2, assembly 10 generally includes lip balm or another consumable product 20, a spring biasing member 30, a first container element 40, a second container element 50, and a third container element 60. Although lip balm 20 is used in a preferred embodiment, it should be understood that various consumable products such as sunscreen, diaper rash products, cosmetic products (e.g., foundation, lipstick and eye shadow) and food materials (e.g., gum and candy) or the like may be used instead of lip balm.

The lip balm 20 is preferably formed in a disc shape as shown in FIG. 2 but may also be arranged in various geometric shapes and sizes. The lip balm may include grooves 26 that extend along opposed broad-sides thereof, as shown in FIG. 2. Such grooves 26 terminate at a semicircular shaped shoulder 24.

Figure 4:
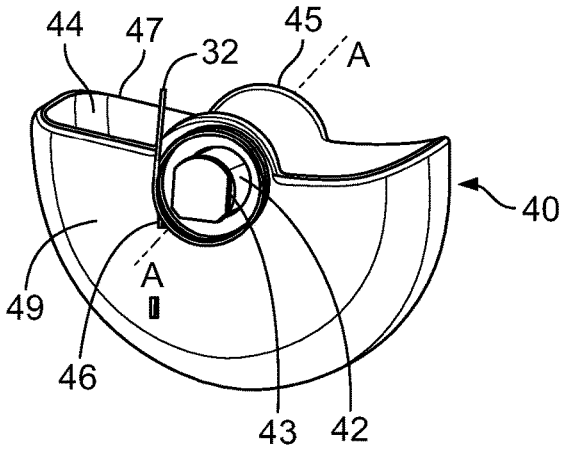
FIG. 4 is a front perspective view of a bottom portion of the container assembly of FIG. 1.

First container element or inner shell 40 is best shown in FIG. 4 and is in the form of a hollow half-disc. In this regard, first container element 40 has a semicircular profile and generally includes a body 49 that defines a first half-disc shaped compartment 44. First compartment 44 is sized to house a first portion 21 of the mass of consumable product 20. Body 49 of the first container element 40 terminates at an edge 47 which defines an opening to first compartment 44. Ears 45 extend from such edge 47 at opposite sides of the compartment 44. Such ears 45 have a semicircular shape and each include a hinge post 42 extending outwardly therefrom. Each hinge post 42 includes a key or male member 43 at an end thereof. A recess 46 extends into body 49 adjacent one of hinge posts 42 and is configured to receive a first arm 31 of biasing member 30, as described in more detail below.

Figure 3:
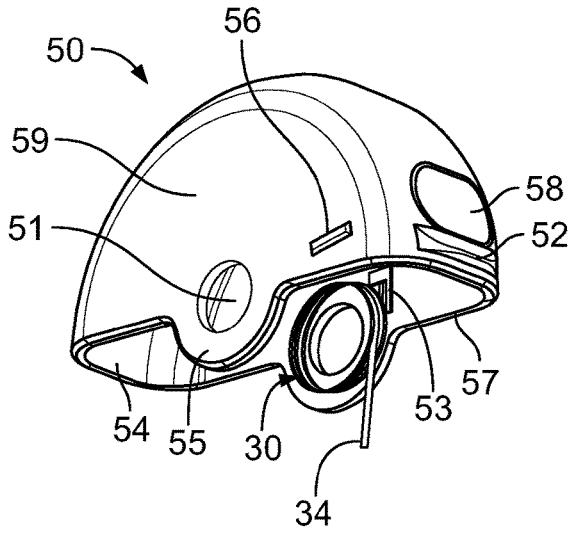
FIG. 3 is a rear perspective view of a top portion of the container assembly of FIG. 1.

Second container element 50, also described as intermediate shell or container lid, is best shown in FIG. 3. Second container element 50 is in the form of a hollow half-disc. In this regard, second container element 50 has a semicircular profile and generally includes a body 59 that defines a second half-disc shaped compartment 54. Second compartment 54 is sized to house first container element 40, as described below. Body 59 of second container element 50 terminates at an edge 57 which defines an opening to second compartment 54. Ears 55 extend from such edge 57 at opposite sides of compartment 54. Such ears 55 each have a post opening 51 extending therethrough. Such post openings 51 are sized to receive corresponding hinge posts 42 of first container element 40. A recess 53 extends into body 59 adjacent one of post openings 51 and is configured to receive a second arm 32 of the biasing member 30. Locking flanges 56 extend outwardly from opposite broad-sides of body 59 and are configured to correspondingly engage with locking recesses 62 of third container element 60, described below. In addition, second container element 50 also includes a lever 52 that extends outwardly from a narrow side of body 59 and is positioned adjacent edge 57 of second container element 50. Such lever 52 can be used by a consumer to help move second container element 50 relative to first container element 40 and can also be used as a stop member, as described below. A depression 58 in body is located adjacent lever 52. Such depression 58 may also be used as leverage to help a consumer move second container element 50.

Figure 5:
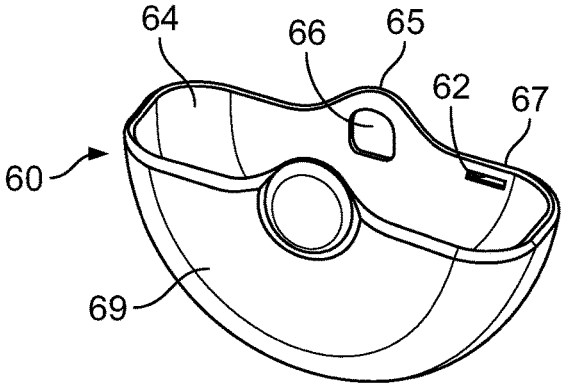
FIG. 5 is a front perspective view of a further bottom portion of the container assembly of FIG. 1.

Third container element or exterior shell 60 is best shown in FIG. 5. Third container element 60 is in the form of a hollow half-disc. In this regard, third container element 60 has a semicircular profile and generally includes a body 69 that defines a third half-disc shaped compartment 64. Third compartment 64 is sized to house second container element 50, as described below. Body 69 of the third container element 60 terminates at an edge 67 which defines an opening to third compartment 64. Ears 65 extend from such edge 67 at opposite sides of the compartment 64. Each of ears 65 have a keyway or female member 66 extending therein from an interior surface thereof. Such keyways 66 match keys 43 at the end of hinge posts 42 so that when keys 43 are received in keyways 66, third container element 60 is prohibited from movement relative to first container element 40. In addition, third container element 60 includes locking recesses 62 that extend into an interior surface of body 69 at opposite broad-sides thereof. Such recesses 62 are positioned adjacent edge 67 and are configured to receive corresponding locking flanges 56 so that locking flanges 56 and recesses 62 combine to form a locking feature that locks second container element 40 to third container element 60. Other locking features are also contemplated, such as a ball-detent or hook-lever mechanism, for example.

Figure 7:
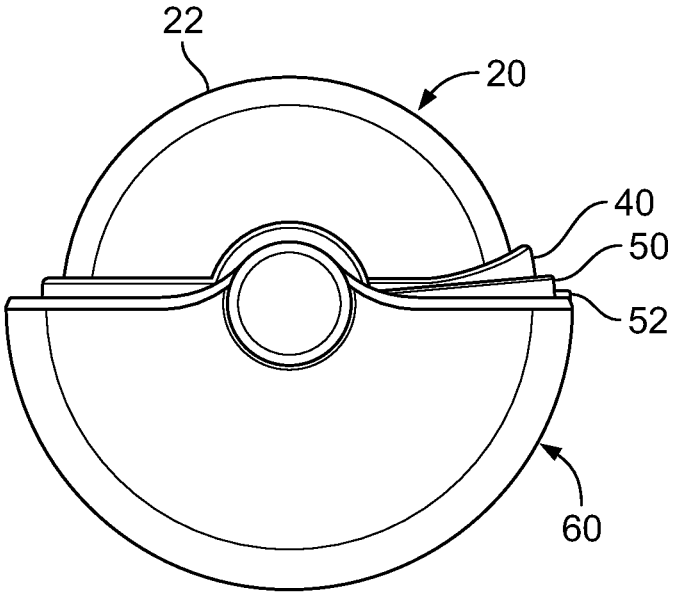
FIG. 7 is an elevational view of the container assembly of FIG. 1 in an open configuration.
Figure 8:
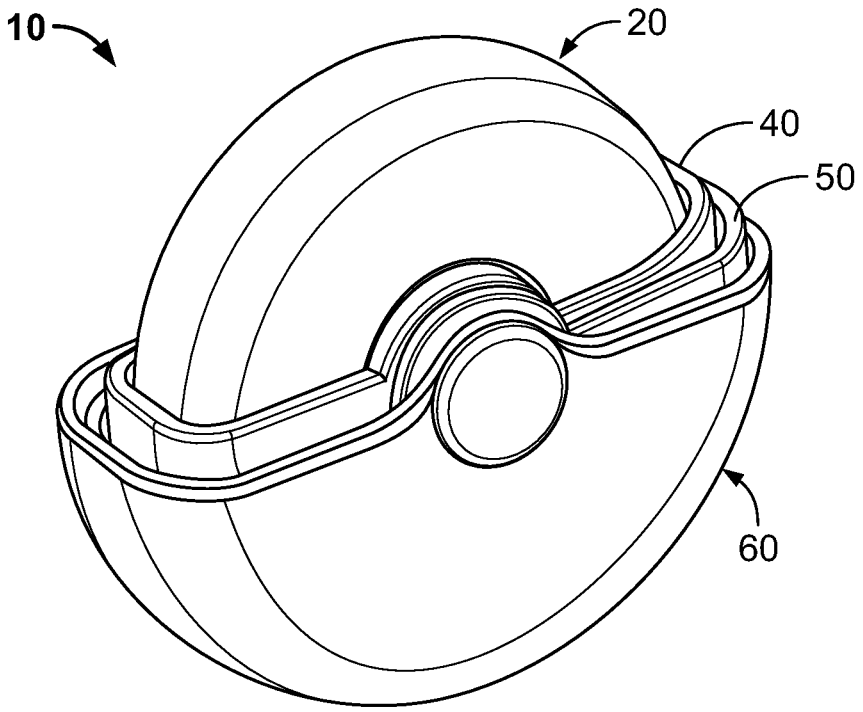
FIG. 8 is a perspective view of the container assembly of FIG. 1 in the open configuration.

When assembly 10 is fully assembled, a first portion 21 of consumable product 20 is disposed within first compartment 44 of first container element 40 so that a second portion 22 of consumable product 20 extends from first compartment 44, as best shown in FIGS. 7 and 8. In this regard, semicircular ears 45 of first container element 40 are received within groove 26 of the lip balm 20 and abut semicircular shoulders 24 thereof so that the lip balm 20 is suspended by ears 45 within first compartment 44.

Second container element 50 is connected to first container element 40 via hinge posts 42. In this regard, hinge posts 42 extend through post openings 51 of second container element 50. This allows second container element 50 to rotate about a hinge/pivot axis A defined by hinge posts 42. Biasing member 30 is preferably a compression spring, as shown in FIG. 2. Such biasing member 30 is connected to both first and second container elements 40, 50. In this regard, biasing member 30 is placed over one of the hinge posts 42 and is positioned between first and second container elements 40, 50. A first arm 31 of compression spring extends into recess 46 within body 49 of first container element 40, and a second arm 32 of biasing member 30 extends into recess 53 within body 50 of second container element 50.

Third container element 60 is positioned over first container element 40 so that first container element 40 is received within third compartment 64 of third container element 60. Third container element 60 is sized so as to form a gap between an exterior of first container element 40 and an interior of third container element 60. Such gap or separation between first and third container elements 40, 60 is sufficiently large as to be capable of receiving second container element 50 therein. In other words, second container element 50 can be selectively disposed between first and third container elements 40, 60. Third container element 60 is connected to first container element 40 via hinge posts 42. In this regard, keys 43 at the end of hinge posts 42 are received in respective keyways 66 of third container element 60. Keys 43 and keyways 66 are configured to prohibit movement of third container element 60 relative to first container element 40. In particular, third container element 60 is prohibited from rotating relative to first container element 40.

Figure 6:
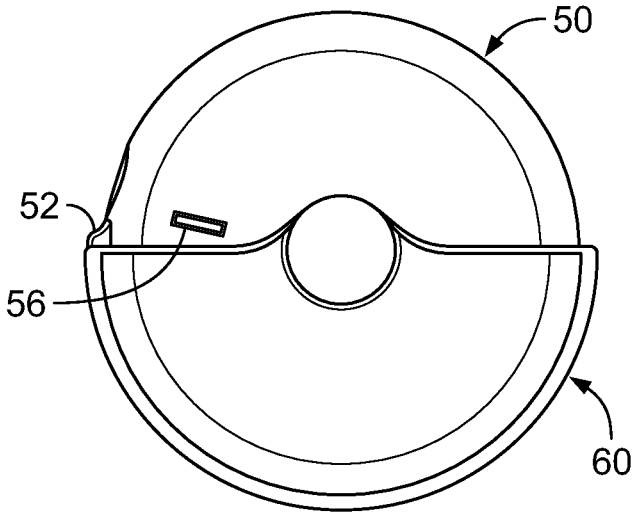
FIG. 6 is an elevational view of the container assembly of FIG. 1 in a closed configuration.

In operation, second container element 50 is moveable from a first position or closed position to a second position or open position. In the closed position, as shown in FIG. 6, container elements 40, 50, 60 together form a circular disc about consumable product 20 so as to form a container having a full-circle profile. Biasing member 30 biases second container element 50 toward the closed position and lever 52 abuts edge 57 of third container element 60 to prevent second container element 50 from over-rotating thereby allowing second container element 50 to maintain a biased first position.

When the bias of biasing member 30 is overcome by a user/consumer, for example, by pushing on lever 52, second container element 50 rotates about the hinge axis A-A toward the second position. In this regard, second container element 50 uncovers consumable product 20 and moves into the gap between first and third container elements 40, 60. As second container element 50 is moved into position between first and third container elements 40, 60, locking flanges 56 abut edge 67 of third container element 60. Additional pressure by the consumer causes locking flanges 56 to flex body 69 so that body 69 expands laterally allowing locking flanges 56 to enter into third compartment 64. When locking flanges 56 reach their associated locking recesses 62, flanges 56 snap into locking recesses 62 and body 69 of third container element 60 flexes back into its original state, thereby locking second container element 50 in the open position. This can occur as container elements 40, 50, 60 are preferably made from a flexible polymer material.

Figure 9:
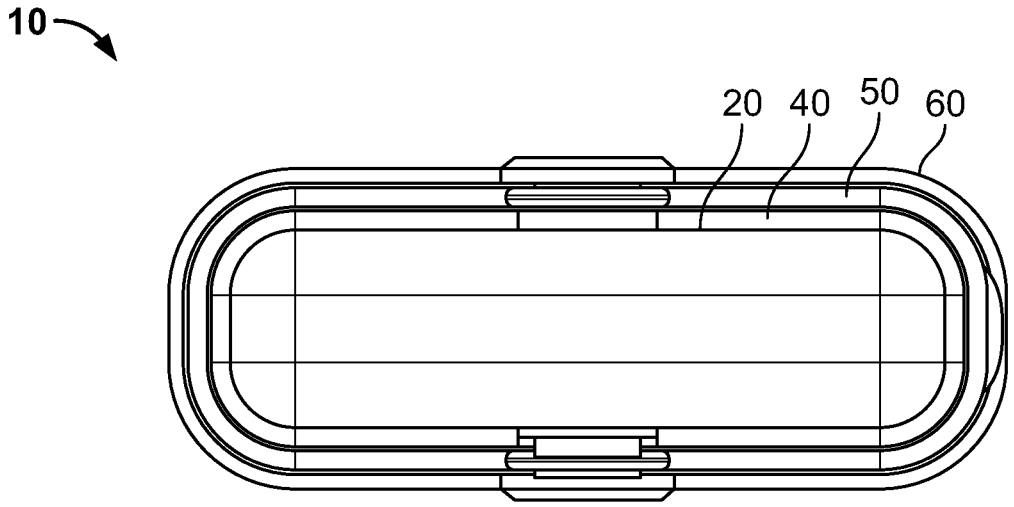
FIG. 9 is a top view of the container assembly of FIG. 1 in the open configuration.

When second container element 50 is in the open position, as shown in FIGS. 7-9, lip balm 20 is exposed for the consumer's use. Once the consumer is done using the lip balm 20, the consumer can easily move second container element 50 back into the closed position. In this regard, consumer may push on lever 52 in an opposite direction causing locking flanges 56 to be removed from locking recesses 62 and once again causing body 69 to flex laterally outwardly. Once locking flanges 56 clear edge 67 of third container element 60, the consumer can release lever 52 allowing biasing member 30 to automatically return second container element 50 back to the closed position, whereby container elements 40, 50 and 60 completely encapsulate the lip balm 20. Thus, minimal manipulation of second container element 50 is required to close container assembly 10. The disc shape of container assembly 10 helps minimize empty space between the container elements 40, 50, 60 and the lip balm 20. In addition, the disc shape allows container assembly 10 to be comfortably placed in a pants pocket or sleekly placed within a purse for later use.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A lip balm container, comprising:

a first container element defining a first compartment configured to house a first portion of lip balm such that a second portion of the lip balm extends from the compartment;

a second container element connected to the first container element and moveable relative thereto between a closed and an open position, wherein in the closed position, the second container element covers the second portion of the mass of lip balm extending from the first compartment of the first container element, and in the open position, the second portion of the lip balm is exposed for use, and wherein the second container element remains connected to the first container element as the second container element is moved between the open and closed positions; and a third container element being connected to the first container element so as to form a space therebetween, the space being configured to receive the second container element when the second container element is in the open position, wherein the second and third container elements define a locking feature that engages when the second container element is in the open position so as to lock the second container element in the open position, the locking feature includes a flange and recess configured to receive the flange in the locking configuration.

2. The lip balm container of claim 1, wherein the second container element is hingedly connected to the first container element.

3. The lip balm container of claim 1, wherein the first and second container elements each have a semi-circular profile and are connected to each other such that when the second container element is in the closed position, the first and second container elements combine to form a full-circle profile.

4. The lip balm container of claim 3, wherein the second container defines a second compartment, and the first and second compartments combine to form a disc shaped compartment configured to receive the mass of lip balm when the second compartment is in the closed position.

5. The lip balm container of claim 3, wherein the second container element is connected to the first container element by a hinge that defines a pivot axis about which the second container element pivots as it moves between the closed and open positions, the pivot axis being substantially aligned with a center of the full-circle profile defined by the first and second container elements.

6. The lip balm container of claim 1, wherein the second container element is biased to the closed position by a biasing member.

7. The lip balm container of claim 6, wherein the biasing member is a torsion spring connected to the first and second container elements.

8. The lip balm container of claim 1, wherein the first and third container elements are rigidly fixed relative to each other and the second container element is moveable relative to the first and third container elements.

9. The lip balm container of claim 1, wherein the third container element includes a third compartment configured to receive the second container element, and the second container element includes a second compartment configured to receive the first container element such that when the second container element is in the open position, the first container element houses the first portion of the mass of lip balm, the second container element houses the first container element, and the third container element houses the second container element.

10. A skin protectant consumable good, comprising:

skin protectant material;

a first container element defining a first compartment, the skin protectant material being disposed within the first compartment;

a second container element moveably connected to the first container element so that the second container element is moveable between closed and open positions, wherein the second container element is biased toward the closed position, and wherein in the closed position, the skin protectant material is completely encapsulated by the first and second container elements and in the open position, the skin protectant material is exposed for use; and a third container element, the first container element being connected to the third container element and disposed within a compartment thereof such that a space is defined between the first and third container elements, the second container element being moveable into and out of the space between the first and third container elements when moving between the respective open and closed positions, wherein the second container element includes a projection or a recess at an outer surface thereof, and the third container element includes a corresponding recess or projection at an inner surface thereof for locking communication when the second container is in the open position.

11. The consumable good of claim 10, wherein the skin protectant is one of lip balm and sunscreen.

12. The consumable good of claim 10, wherein the second container is biased toward the closed position via a spring.

13. The consumable good of claim 10, wherein the second container element is connected to hinge posts that extend outwardly and oppositely from the first container element, the hinge posts defining a hinge axis about which the second container element rotates.

14. The consumable good of claim 10, wherein the first and second container elements form a disc shaped shell surrounding the skin protectant material when the second container element is in the closed position.

* * * * *